US011259682B2

(12) United States Patent
Lee et al.

(10) Patent No.: US 11,259,682 B2
(45) Date of Patent: Mar. 1, 2022

(54) DISHWASHER

(71) Applicant: SAMSUNG ELECTRONICS CO., LTD., Suwon-si (KR)

(72) Inventors: Chang Wook Lee, Seoul (KR); Sung Jin Kim, Suwon-si (KR); Seung Wan Yoo, Suwon-si (KR); Seung Min Chae, Hwaseong-si (KR); Jin Doo Kim, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 48 days.

(21) Appl. No.: 16/643,763

(22) PCT Filed: Apr. 3, 2018

(86) PCT No.: PCT/KR2018/003899

§ 371 (c)(1),
(2) Date: Mar. 2, 2020

(87) PCT Pub. No.: WO2019/045211

PCT Pub. Date: Mar. 7, 2019

(65) Prior Publication Data

US 2020/0221919 A1 Jul. 16, 2020

(30) Foreign Application Priority Data

Aug. 31, 2017 (KR) ..... 10-2017-0111476

(51) Int. Cl.
*A47L 15/00* (2006.01)
*A47L 15/16* (2006.01)
(Continued)

(52) U.S. Cl.
CPC ..... *A47L 15/16* (2013.01); *A47L 15/0086* (2013.01); *A47L 15/4221* (2013.01);
(Continued)

(58) Field of Classification Search
None
See application file for complete search history.

(56) References Cited

FOREIGN PATENT DOCUMENTS

EP 1 358 836 A2 11/2003
FR 2 004 067 A1 11/1969
(Continued)

OTHER PUBLICATIONS

KR 20110006400 U, "KR20110006400U English Machine Translation.pdf", Jun. 24, 2011—Machine translation from Espacenet.com.*
(Continued)

*Primary Examiner* — Levon J Shahinian
(74) *Attorney, Agent, or Firm* — Staas & Halsey, LLP

(57) ABSTRACT

The present disclosure relates to a dishwasher having a structure improved in convenience of use. The dishwasher includes a tub having a front opening and a top opening, a front door configured to open and close the front opening, a cover frame disposed on the top opening and including an opening opened in the up-down direction, a top door configured to open and close the opening of the cover frame, and a frame injector disposed on the cover frame to inject washing water from one side of the cover frame.

17 Claims, 17 Drawing Sheets

(51) Int. Cl.
*A47L 15/42* (2006.01)
*A47L 15/50* (2006.01)

(52) U.S. Cl.
CPC ..... *A47L 15/4257* (2013.01); *A47L 15/4261* (2013.01); *A47L 15/4263* (2013.01); *A47L 15/4278* (2013.01); *A47L 15/508* (2013.01)

(56) References Cited

FOREIGN PATENT DOCUMENTS

| | | |
|---|---|---|
| GB | 929 348 A | 6/1963 |
| JP | 11-178661 | 7/1999 |
| JP | 2004-329249 | 11/2004 |
| KR | 10-1999-0076479 | 10/1999 |
| KR | 10-0271711 | 5/2001 |
| KR | 20-2011-0006400 | 6/2011 |
| KR | 10-1643740 | 7/2016 |

OTHER PUBLICATIONS

Extended European Search Report dated Apr. 8, 2020, in corresponding European Patent Application No. 18850473.2.
Korean Office Action dated Sep. 23, 2021, in Korean Application No. 10-2017-0111476.

* cited by examiner

DISHWASHER

CROSS-REFERENCE TO RELATED APPLICATIONS

This application is a U.S. National Stage Application which claims the benefit under 35 U.S.C. § 371 of International Patent Application No. PCT/KR2018/003899 filed on Apr. 3, 2018, which claims foreign priority benefit under 35 U.S.C. § 119 of Korean Patent Application No. 10-2017-0111476 filed on Aug. 31, 2017 in the Korean Intellectual Property Office, the contents of both of which are incorporated herein by reference.

TECHNICAL FIELD

The present disclosure relates to a dishwasher, and more particularly, to a dishwasher having a structure improved in convenience of use.

BACKGROUND ART

A dishwasher is an appliance that automatically washes food residues on tableware using a detergent and washing water.

As an example, a dishwasher includes a main body having a front opening and a tub disposed therein, a door installed on the main body to open and close the front opening, a basket provided to receive tableware, an injection nozzle provided to inject washing water, and the like. In such a front loading type dishwasher, food residues on the tableware may fall on a floor where the dishwasher is installed in the process of loading the tableware into the basket.

As another example, a dishwasher includes a main body having a top opening and a tub disposed therein, a door installed on the main body to open and close the top opening, a basket provided to receive tableware, an injection nozzle provided to inject washing water, and the like. In such a top loading type dishwasher, interference between an upper space of the tub and the door may make it difficult to load tableware having a certain size or more.

Therefore, there is a great expectation for a new type of dishwasher capable of removing the limitations of the front loading type dishwasher and the top loading type dishwasher.

DISCLOSURE

Technical Problem

The present disclosure is directed to providing a dishwasher having an improved structure to enable front loading and top loading of tableware.

The present disclosure is directed to providing a dishwasher having an improved structure to prevent contamination that may occur in a frame supporting a top door.

Technical Solution

One aspect of the present disclosure provides a dishwasher including a tub having a front opening and a top opening, a front door configured to open and close the front opening, a cover frame disposed on the top opening and including an opening opened in the up-down direction, a top door configured to open and close the opening of the cover frame, and a frame injector disposed on the cover frame to inject washing water from one side of the cover frame.

The cover frame may further include a seating portion configured to face a lower surface of the top door when the top door is closed, and the frame injector may be disposed on the seating portion to remove foreign substances on the seating portion.

The dishwasher may further include a door hinge disposed at the seating portion to allow the top door to be rotatably coupled to the cover frame, wherein the frame injector may be disposed at an outer side of the hinge member on the seating portion with respect to a center of the tub.

The frame injector may be configured to inject the washing water toward the door hinge.

The top door may include a sealing member provided on the lower surface of the top door to be in contact with the seating portion when the top door is closed, and the frame injector may be disposed at an outer side of the sealing member with respect to a center of the tub.

The top door may include a sealing member provided on the lower surface of the top door to be in contact with the seating portion when the top door is closed, and the frame injector may be disposed at an inner side of the sealing member with respect to a center of the tub.

The dishwasher may further include a simple tray disposed on an inner wall of the cover frame, wherein the frame injector may be configured to inject the washing water toward the simple tray.

The dishwasher may further include a simple tray disposed on an inner wall of the cover frame and an auxiliary frame injector disposed on the cover frame and configured to inject the washing water toward the simple tray.

The seating portion may include a water collecting region provided at a relatively low height with respect to the up-down direction such that the washing water injected from the frame injector is collected in one side of the seating portion.

The cover frame may further include a drain hole to drain the washing water collected in the cover frame.

The cover frame may further include a seating portion configured to face a lower surface of the top door when the top door is closed, a lower inner wall extending from an inner end of the seating portion to the tub side, an inlet hole disposed on the lower inner wall such that the washing water drained from the drain hole is introduced into the tub, and a connection hose to connect the drain hole to the inlet hole.

The dishwasher may further include a connection member to connect an upper end of the tub to the cover frame, wherein the connection hose may be configured to penetrate the connection member to connect the drain hole to the inlet hole.

The connection hose may include a U-shaped region having a 'U' shape formed lower than the inlet hole in the up-down direction.

The drain hole may be disposed on the seating portion.

The seating portion may include a water collecting region provided at a relatively low height with respect to the up-down direction such that the washing water injected from the frame injector is collected in the drain hole side.

Another aspect of the present disclosure provides a dishwasher including a tub having a front opening and a top opening, a front door configured to open and close the front opening, a cover frame disposed on the top opening and including an opening opened in the up-down direction, and a top door configured to open and close the opening of the cover frame, wherein the cover frame includes a seating portion configured to face a lower surface of the top door when the top door is closed, a drain hole to drain the washing water collected in the seating portion to an outer side of the cover frame, a lower inner wall extending from an inner end of the seating portion to the tub side, an inlet hole disposed on the lower inner wall such that the washing water drained from the drain hole is introduced into the tub, and a connection hose to connect the drain hole to the inlet hole.

The cover frame may further include a frame injector disposed on the seating portion to inject the washing water.

The top door may include a sealing member provided on the lower surface of the top door to be in contact with the seating portion when the top door is closed, and the frame injector may be disposed at an outer side of the sealing member with respect to a center of the tub.

The cover frame may further include an upper inner wall extending from an outer end of the seating portion to the top door side, and the drain hole may be disposed at the outer side of the sealing member with respect to the center of the tub to drain the washing water collected between the sealing member and the upper inner wall.

Another aspect of the present disclosure provides a dishwasher installed on a system kitchen in a built-in manner, the system kitchen including a cabinet having a receiving space and a counter disposed on the cabinet and having an opening, wherein the dishwasher includes a tub having a front opening, a front door configured to open and close the front opening of the tub, a cover frame disposed at an upper portion of the tub and mounted on the opening, a top door configured to open and close the opening, a first washing space formed inside the tub, a second washing space formed by an upper portion of the first washing space and defined by the cover frame, and a frame injector disposed on the cover frame to inject washing water to one of the cover frame and the second washing space.

Advantageous Effects

As a dishwasher including a front door and a top door is implemented, both front loading and top loading of tableware can be performed. In addition, as the top door provided for top loading and a cover frame in which the top door is seated are included and a frame injector provided to send foreign substances on the cover frame to a tub side is included, contamination of the cover frame can be effectively prevented.

MODE OF THE INVENTION

Hereinafter embodiments of the present disclosure will be described in detail with reference to the accompanying drawings. In this specification, the terms "front end," "rear end," "upper portion," "lower portion," "upper end" and "lower end" used in the following description are defined with reference to the drawings, and the shape and position of each component are not limited by these terms.

Figure 1:
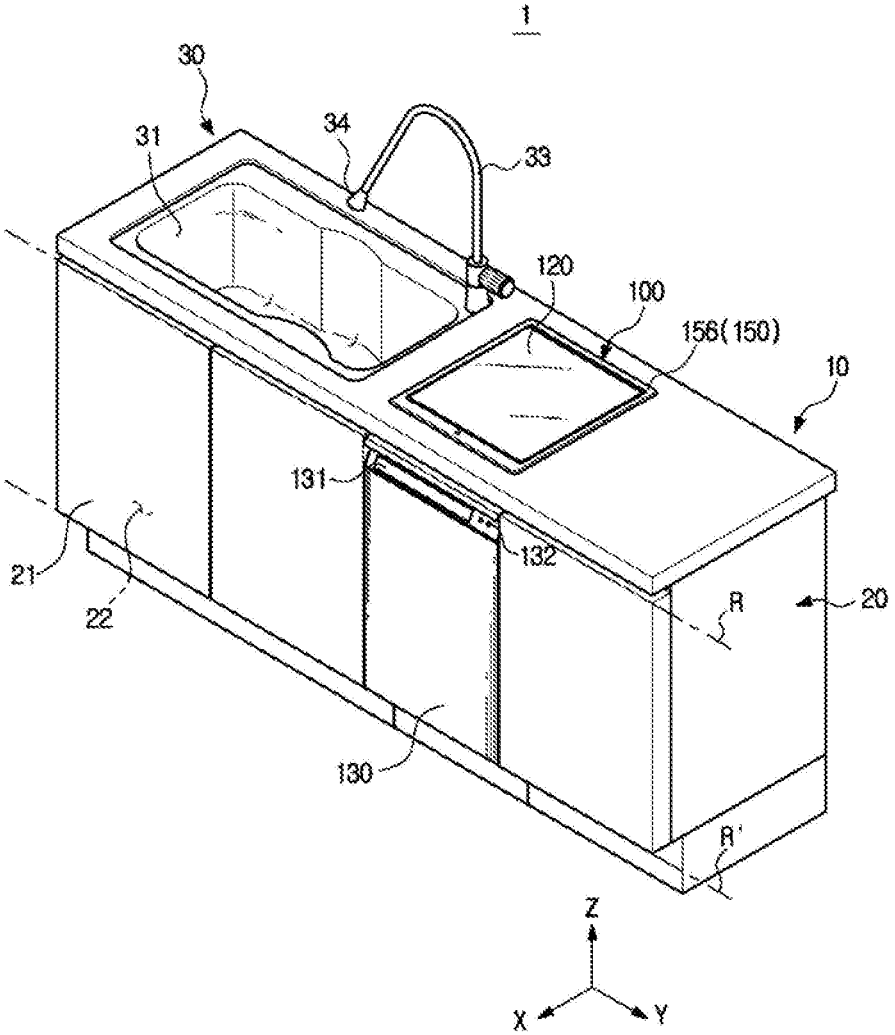
FIG. 1 is a view illustrating a system kitchen in which a dishwasher according to an embodiment of the present disclosure is installed in a built-in manner.
Figure 2:
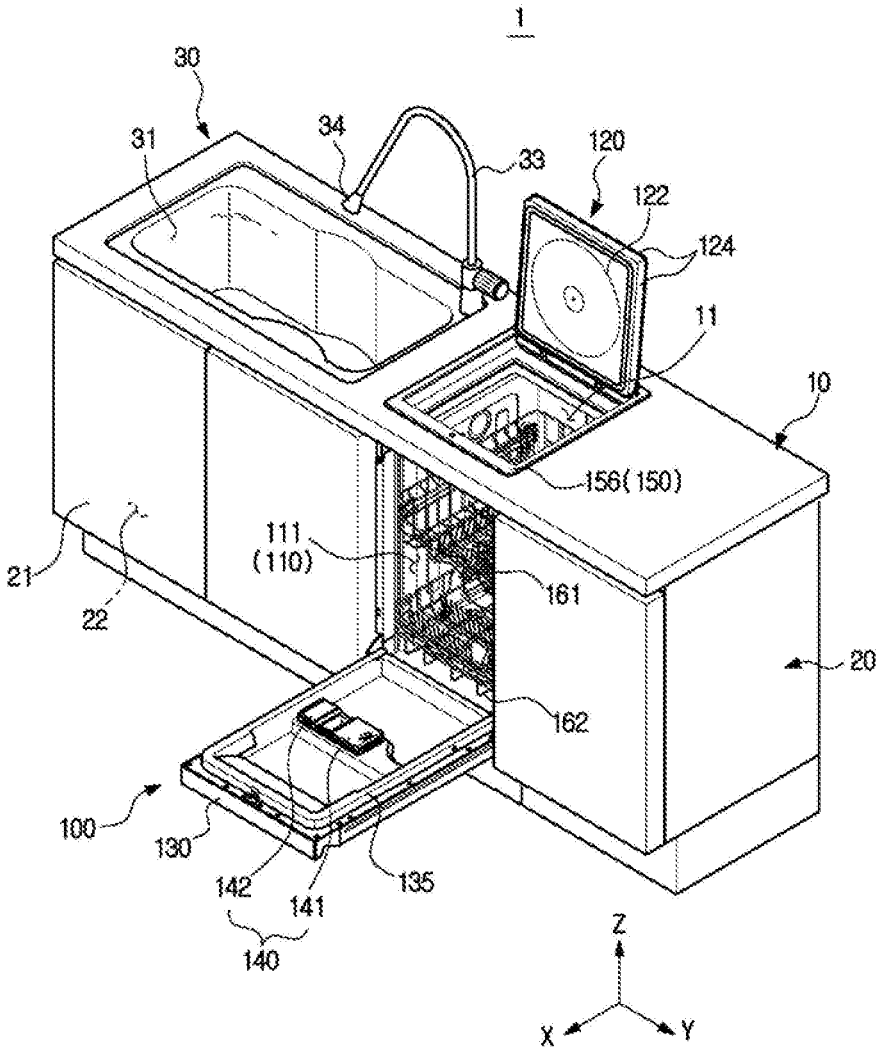
FIG. 2 is a view illustrating a state in which a front door and a top door of the dishwasher are opened in the system kitchen in FIG. 1.

FIG. 1 is a view illustrating a system kitchen in which a dishwasher according to an embodiment of the present disclosure is installed in a built-in manner, and FIG. 2 is a view illustrating a state in which a front door and a top door of the dishwasher are opened in the system kitchen in FIG. 1. Hereinafter "X" represents a front-rear direction of a system kitchen 1, "Y" represents a left-right direction of the system kitchen 1, and "Z" represents an up-down direction of the system kitchen 1. The left-right direction of the system kitchen 1 may be referred to as a width direction of the system kitchen 1. The up-down direction of the system kitchen 1 may be referred to as a height direction of the system kitchen 1. In addition, the front-rear direction, the left-right direction, and the up-down direction of the system kitchen 1 may be referred to as a front-rear direction, a left-right direction, and an up-down direction of a dishwasher 100.

As illustrated in FIGS. 1 and 2, the system kitchen 1 may include a cabinet 20 having a receiving space 22 and a counter 10 disposed on the cabinet 20. The counter 10 may have a flat plate shape. The counter 10 may be named a "cooking table." An opening 11 may be formed on the counter 10.

The cabinet 20 may be provided with the receiving space 22 in which various kitchen utensils may be received. The receiving space 22 may be opened and closed by a cabinet door 21. As an example, the cabinet door 21 may be rotatably provided.

The cabinet 20 may include a partition wall (not shown) disposed inside the cabinet 20 to partition the receiving space 22. As an example, the partition wall may be formed to extend in a height direction Z of the system kitchen 1 to partition the receiving space 22 into a plurality of spaces.

The system kitchen 1 may further include a sink 30 to wash tableware or to trim food materials or the like. The sink 30 may be provided at one side of the counter 10. The sink 30 may include a sink bowl 31 installed on the counter 10 to wash tableware or food materials. The sink bowl 31 may be provided with a drain hole (not shown) to drain water supplied to the sink bowl 31. The sink 30 may further include a water pipe 33 installed adjacent to the sink bowl 31 to supply water to the sink bowl 31. A faucet 34 may be coupled to one end of the water pipe 33. Water supplied from the faucet 34 to the sink bowl 31 may be drained through the drain hole and a drain pipe (not shown) connected to the drain hole. \

The system kitchen 1 may further include the dishwasher 100 installed in the system kitchen 1 in a built-in manner.

The dishwasher 100 may include a plurality of doors 120 and 130 for the convenience of a user. Specifically, the dishwasher 100 may include the top door 120 provided to enable top loading of tableware, and the front door 130 provided to enable front loading of the tableware. The top door 120 and the front door 130 may be rotatably installed. However, the installation manner of the top door 120 and the front door 130 is not limited to the above example, and may be variously changed. As an example, the top door 120 and the front door 130 may be installed to open or close in a sliding manner. As another example, one of the top door 120 and the front door 130 may be installed to open or close in a sliding manner, and the other of the top door 120 and the front door 130 may be opened or close in a rotating manner. Hereinafter the case where the top door 120 and the front door 130 are rotatably installed will be described. The top door 120 may be rotatably installed on a cover frame 150. The front door 130 may be rotatably installed on a tub 110.

The front door 130 may be provided with a detergent supply device 140 including at least one of a detergent box 141 to supply a detergent to the inside of the tub 110 and a rinse box 142 to supply a rinse to the inside of the tub 110.

A display 131 to display an operation state of the dishwasher 100 and the like may be provided on the front door 130. Specifically, the display 131 may be provided on an upper side of a front surface of the front door 130. The display 131 may be implemented in a touch screen structure such that the user may input a command.

An operating portion 132 may be provided on the front door 130. As an example, the operating portion 132 may include a power button and the like of the dishwasher 100. The operating portion 132 may be provided on one side of the display 131.

Preferably, at least one of the display 131 and the operating portion 132 may be provided on the front door 130.

The dishwasher 100 may further include the tub 110. The tub 110 may include a front opening 111 capable of being opened and closed by the front door 130. Preferably, the front opening 111 may be larger than the opening 11 formed on the counter 10. The tub 110 may further include a top opening 112 (see FIG. 4) provided to correspond to the opening 11 formed on the counter 10. The cover frame 150, which will be described later, is disposed above the top opening 112, and the top opening 112 may be finally opened and closed by the top door 120.

The dishwasher 100 may further include the cover frame 150. The cover frame 150 may be mounted on the opening 11. The top door 120 may be installed to the cover frame 150. The cover frame 150 may be mounted to the opening 11 in a state in which a portion of the cover frame 150 is placed on the counter 10 around the opening 11. That is, the cover frame 150 may include a bent portion 156 formed at one end thereof to be hung on the counter 10. The bent portion 156 of the cover frame 150 may be exposed to the outside. A width w1 of the cover frame 150 exposed to the outside may be larger than a width w2 of the opening 11 formed on the counter 10 (see FIG. 3). In this case, the width w1 of the cover frame 150 and the width w2 of the opening 11 are measured based on the width direction Y of the system kitchen 1. Therefore, the cover frame 150 may be mounted in the opening 11 in a state in which the bent portion 156 of the cover frame 150 is supported by the counter 10.

Figure 4:
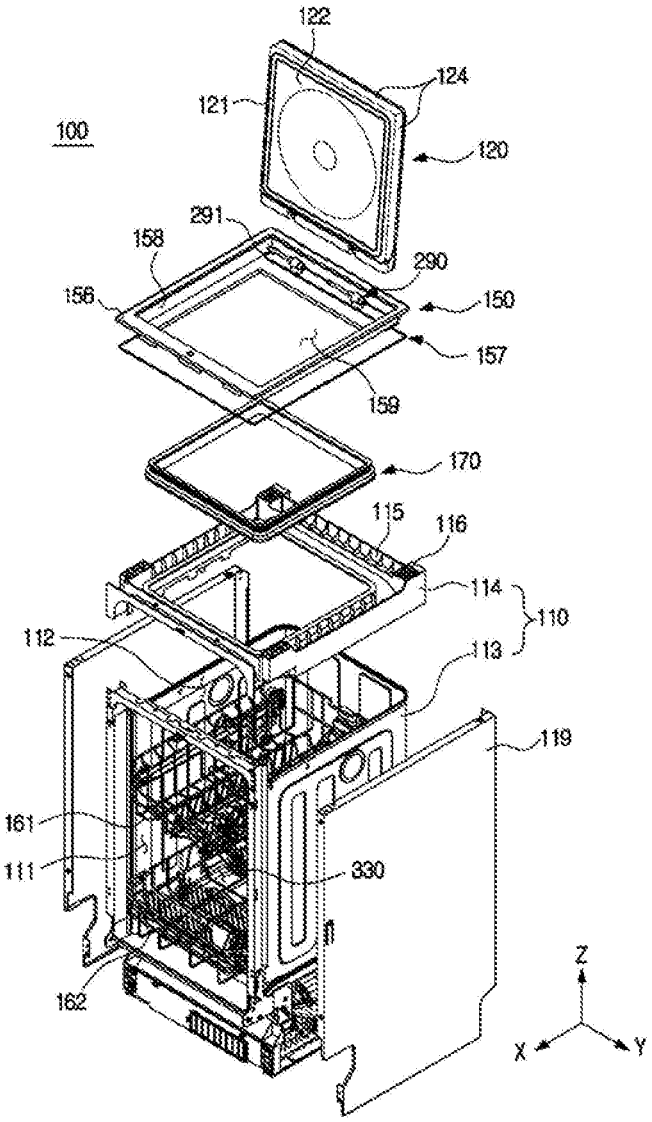
FIG. 4 is an exploded perspective view of the dishwasher according to an embodiment of the present disclosure.

The cover frame 150 may include a frame opening 159 opening in the up-down direction (see FIG. 4). The user may withdraw tableware from an upper side of the tub 110 through the opening 11 of the counter 10, the frame opening 159, and the top opening 112 of the tub 110.

The dishwasher 100 may include a washing space 320 defined as an inner space of the tub 110 and the cover frame 150. The washing space 320 may include a first washing space 330 formed inside the tub 110 and a second washing space 340 formed above the first washing space 330.

The second washing space 340 may be formed between the top door 120 and the tub 110. The second washing space 340 may be defined by the cover frame 150. Specifically, the second washing space 340 may be defined by a second wall 153 of the cover frame 150. More specifically, the second washing space 340 may be defined by the top door 120, the second wall 153 of the cover frame 150, a connection member 170, and the tub 110.

The dishwasher 100 may further include one or more baskets 161 and 162 disposed inside the tub 110 to be withdrawn through the front opening 111. The one or more baskets 161 and 162 may also be named "front loading baskets." As an example, the dishwasher 100 may include the upper basket 161 disposed at an upper portion of the tub 110 in the up-down direction Z of the dishwasher, and the lower basket 162 disposed below the upper basket 161 in the up-down direction Z of the dishwasher.

The front door 130 of the dishwasher 100 may form an appearance of the system kitchen 1. Specifically, the front door 130 of the dishwasher 100 may form a front appearance of the system kitchen 1 together with a cabinet door 21.

An upper end portion of the front door 130 and an upper end portion of the cabinet door 21 may be positioned on a reference line R extending in the width direction Y of the system kitchen 1. The reference line R may be an imaginary line extending in the width direction Y of the system kitchen 1 to be parallel to the counter 10. As the upper end portion of the front door 130 and the upper end portion of the cabinet door 21 is designed to be positioned on a straight line, the system kitchen 1 having a neat image with a sense of unity as a whole may be implemented.

Preferably, a lower end portion of the front door 130 and a lower end portion of the cabinet door 21 may also be positioned on a reference line R' extending in the width direction Y of the system kitchen 1. The reference line R' may be an imaginary line extending in the width direction Y of the system kitchen 1 to be parallel to the counter 10. That is, the reference line R' may be parallel to the reference line R.

The top door 120 of the dishwasher 100 may form an appearance of the system kitchen 1. Specifically, the top door 120 of the dishwasher 100 may form a top appearance of the system kitchen 1 together with the counter 10. The top door 120 may be provided such that a step with the counter 10 is not large in the height direction Z of the system kitchen 1. When the top door 120 may be provided such that the step with the counter 10 is large in the height direction Z of the system kitchen 1, that is, when the top door 120 is provided to protrude excessively upward of the system kitchen 1, the convenience of use may be lowered. As an example, the user may bump into the top door 120 protruding excessively upward of the system kitchen 1.

Figure 3:
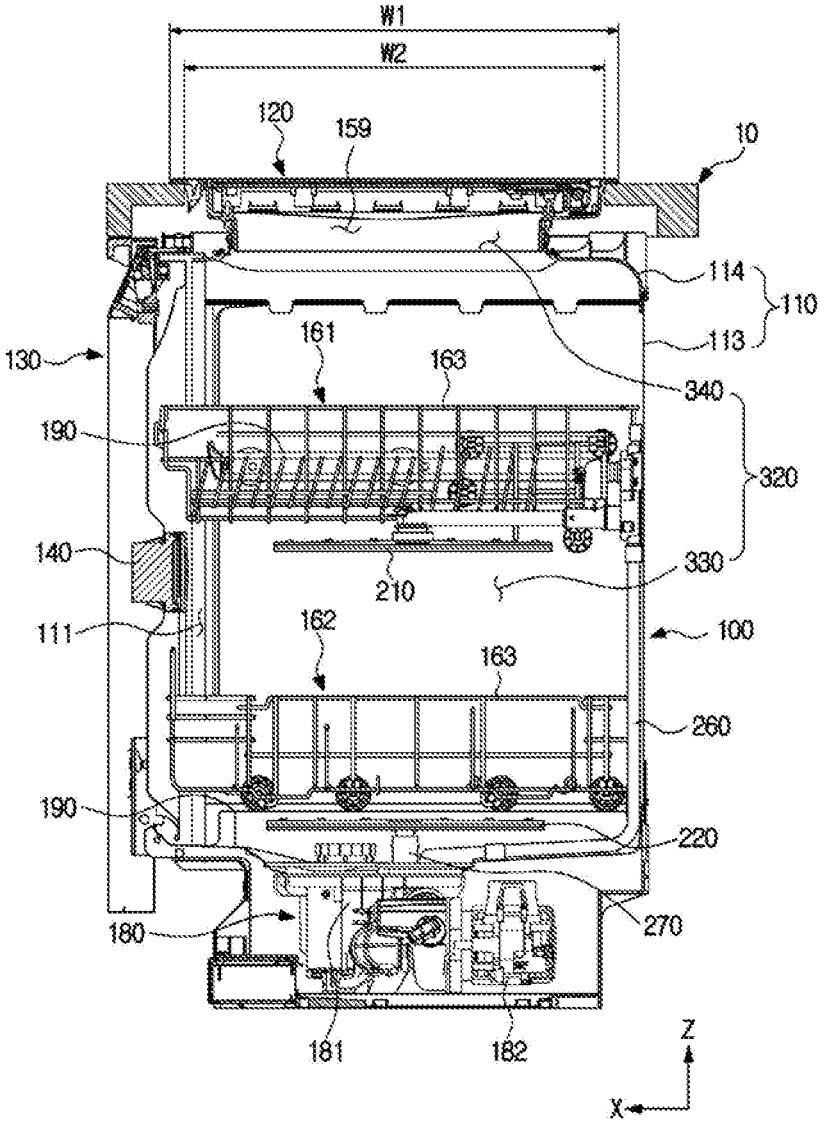
FIG. 3 is a cross-sectional view taken along line C-C' in the system kitchen of FIG. 1.
Figure 5:
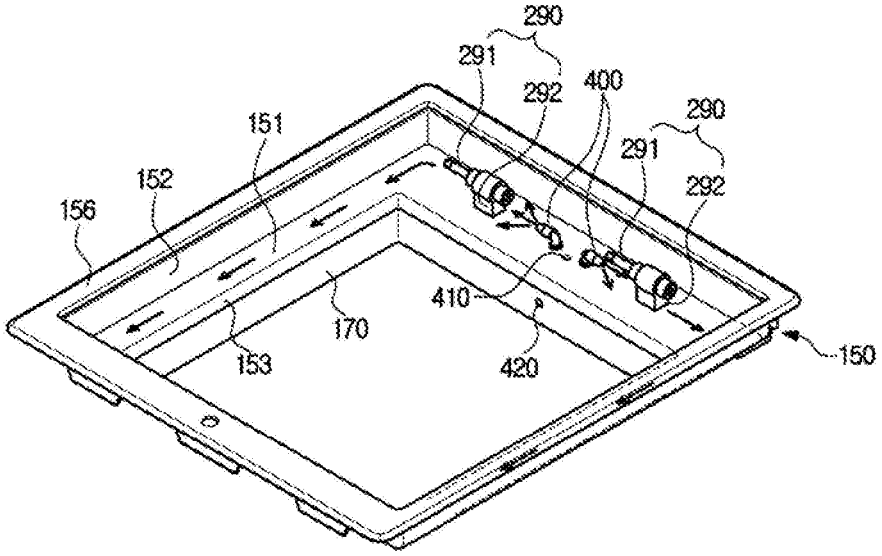
FIG. 5 is a perspective view illustrating a cover frame and a frame injector of the dishwasher according to an embodiment of the present disclosure.

FIG. 3 is a cross-sectional view taken along line C-C' in the system kitchen of FIG. 1, and FIG. 4 is an exploded perspective view of the dishwasher according to an embodiment of the present disclosure. FIG. 5 is a perspective view illustrating a cover frame and a frame injector of the dishwasher according to an embodiment of the present disclosure. For reference, the front door 130 is omitted in FIG. 4.

As illustrated in FIGS. 3 to 5, the dishwasher 100 may include the tub 110 having the washing space 330 formed therein and a sump 180 provided below the tub 110 to store washing water.

The one or more baskets 161 and 162 may be disposed inside the tub 110 to be movable in the front-rear direction X of the system kitchen 1. Specifically, the one or more baskets 161 and 162 may be drawn in and out through the front opening 111 of the tub 110 by at least one rack 190 slidably supporting the one or more baskets 161 and 162.

The one or more baskets 161 and 162 may have an open top to allow tableware to be received therein. The one or more baskets 161 and 162 may be formed by wires 163 arranged in a grid shape so that the tableware received therein may be easily washed by washing water. In other words, the one or more baskets 161 and 162 may be formed of the plurality of wires 163 crossing each other to receive the tableware therein.

The dishwasher 100 may further include one or more injectors 210 and 220 provided to inject the washing water. The one or more injectors 210 and 220 may include the first injector 210 positioned between the upper basket 161 and the lower basket 162, and the second injector 220 positioned below the lower basket 162.

The first injector 210 and the second injector 220 may be rotatably installed about a rotating shaft to inject the washing water while rotating.

The tub 110 may be provided with a heater (not shown) for heating the washing water and a heater installation groove (not shown). The heater installation groove may be provided at a bottom of the tub 110, and the heater may be installed in the heater installation groove.

The sump 180 may be provided at the bottom center of the tub 110 to collect and pump the washing water. The sump 180 may include a washing pump 181 for pumping the washing water at a high pressure, and a pump motor 182 for driving the washing pump 181.

The washing pump 181 pumps the washing water to the first injector 210 through a first supply pipe 260. In addition, the washing pump 181 pumps the washing water to the second injector 220 through a second supply pipe 270.

The sump 180 may include a turbidity sensor (not shown) for detecting a degree of contamination of the washing water. The controller (not shown) of the dishwasher 100 may detect the degree of contamination of the washing water using the turbidity sensor (not shown) and may control the number of times of washing or rinsing. That is, when the degree of contamination is high, the washing or rinsing process may be increased, and when the degree of contamination is low, the washing or rinsing process may be reduced.

The dishwasher 100 may further include the cover frame 150 mounted to the opening 11 of the counter 10. The cover frame 150 may be mounted to the opening 11 to be spaced apart from the tub 110 in the height direction Z of the system kitchen 1. In other words, the cover frame 150 may be mounted to the opening 11 not to overlap the tub 110 in the height direction Z of the system kitchen 1.

The cover frame 150 may include a frame body 158, and the bent portion 156 bent from the frame body 158 to be supported on the counter 10. The bent portion 156 may be formed at an upper end portion of the frame body 158 to be bent in an outward direction of the dishwasher 100.

The frame body 158 may include a seating portion 151 provided to seat the top door 120. Specifically, a top door hinge 290 including a hinge shaft 291 and a hinge mounting portion 292 may be mounted on the seating portion 151 of the frame body 158. The top door hinge 290 is coupled to one side of the top door 120, the top door 120 may be mounted to the seating portion 151 as the hinge mounting portion 292 is mounted to the seating portion 151. The top door 120 may be coupled to the top door hinge 290 to be rotatable about the hinge shaft 291. The hinge shaft 291 of the top door hinge 290 may extend in the width direction Y of the system kitchen 1.

The frame body 158 may further include a first wall 152 extending from the seating portion 151 in the height direction Z of the system kitchen 1. Specifically, the first wall 152 may extend in the height direction Z of the system kitchen 1 to direct upward of the system kitchen 1 from an outer end portion of the seating portion 151. The seating portion 151 may face a bottom surface of the top door 120, and the first wall 152 may face a side surface of the top door 120. In another aspect, the seating portion 151 and the first wall 152 may define a top door accommodation space in which the top door 120 is accommodated.

The frame body 158 may further include a second wall 153 extending in the height direction Z of the system kitchen 1 from the seating portion 151. Specifically, the second wall 153 may extend in the height direction Z of the system kitchen 1 to direct downward of the system kitchen 1 from an inner end portion of the seating portion 151.

The second wall 153 may extend further in the height direction Z of the system kitchen 1 than the first wall 152. That is, a height of the second wall 153 may be higher than a height of the first wall 152 in the height direction Z of the system kitchen 1.

A space defined by the first wall 152 may have a width wider than a space defined by the second wall 153 in the width direction Y of the system kitchen 1.

The dishwasher 100 may further include a frame sealing member 157. The frame sealing member 157 may be disposed between the cover frame 150 and the counter 10. In other words, the frame sealing member 157 may be coupled to at least one of the cover frame 150 and the counter 10. The frame sealing member 157 serves to complement sealing between the cover frame 150 and the counter 10 to prevent external fluid from entering the inside of the dishwasher 100 through a gap between the cover frame 150 and the counter 10 or to prevent the washing water in the tub 110 from escaping to the outside of the dishwasher 100 through the gap between the cover frame 150 and the counter 10. The frame sealing member 157 may be formed of an elastic material. As an example, the frame sealing member 157 may be formed of rubber or the like.

The dishwasher 100 may further include a top door sealing member 121. The top door sealing member 121 may be coupled to a lower surface 122 of the top door 120. The top door sealing member 121 serves to complement sealing between the cover frame 150 and the top door 120 to prevent the washing water in the tub 110 from leaking to the outside of the top door 120. The top door sealing member 121 may be formed of an elastic material. As an example, the top door sealing member 121 may be formed of rubber or the like.

When the top door 120 is in a closed state, the lower surface 122 of the top door 120 and the seating portion 151 are disposed to face each other, and the top door sealing member 121 disposed on the lower surface 122 of the top door 120 may be provided to be in close contact with the seating portion 151 to prevent the washing water flowing upward from the tub 110 from escaping to the outside of the seating portion 151.

The dishwasher 100 may further include a housing panel 119. The housing panel 119 may be disposed outside the tub 110. Specifically, the housing panel 119 may be coupled to opposite sidewalls of the tub 110, that is, the left side wall and the right side wall, respectively.

The dishwasher 100 may further include a tub body 113 and a tub top 114 mounted to the tub body 113. The tub top 114 may be coupled to an upper end portion of the tub body 113. The tub top 114 may have the top opening 112 corresponding to the opening 11 of the counter 10.

The tub top 114 may be formed of a material different from the tub body 113. As an example, the tub top 114 may be formed of polypropylene (PP), and the tub body 113 may be formed of stainless steel (STS).

The tub top 114 may be provided with a water collecting portion 115. The water collecting portion 115 may be formed along a circumference of the tub top 114 to have a predetermined depth. The water collecting portion 115 may be formed on the tub top 114 to be positioned outside the connection member 170, which will be described later. When the washing water does not flow into the tub 110 due to incomplete coupling, wear, etc. of the connection member 170 and flows along an outer wall of the tub 110, This is not only unhygienic but may also cause dangerous problems such as fire. The water collecting portion 115 is formed at the top of the tub body 113, that is, the tub top 114 to collect the washing water not introduced into the tub 110 and guide the collected water into the tub 110.

The tub top 114 may be provided with a panel fixing portion 116. The housing panel 119 may be coupled to the tub 110 to face the opposite sidewalls of the tub 110. Specifically, the housing panel 119 may be coupled to the panel fixing portion 116 of the tub top 114 to face the opposite sidewalls of the tub 110. The housing panel 119 may be fixed to the panel fixing portion 116 by a coupling member such as a screw.

The dishwasher 100 may further include the connection member 170. The connection member 170 may be provided to connect the cover frame 150 to the tub 110. Specifically, the connection member 170 may connect the cover frame 150 to the tub 110 to be stretchable and shrinkable in the height direction Z of the system kitchen 1. The connection member 170 may include an elastic material. As an example, the connection member 170 may be formed of rubber or the like. An upper end portion of the connection member 170 may be coupled to the cover frame 150, and a lower end portion of the connection member 170 may be coupled to the tub 110. In outer words, the upper end portion of the connection member 170 may be coupled to the cover frame 150, and the lower end portion of the connection member 170 may be coupled to the tub top 114.

The dishwasher 100 may further include a front door sealing member 135. The front door sealing member 135 may be coupled to the front door 130. The front door sealing member 135 serves to complement sealing between the tub 110 and the front door 130 to prevent the washing water in the tub 110 from leaking to the outside of the front door 130. The front door sealing member 135 may be formed of an elastic material. As an example, the front door sealing member 135 may be formed of rubber or the like.

The top door 120 may include communication means configured to control the operation of the dishwasher 100 according to whether the top door 120 is opened or closed. As an example, a controller (not shown) of the dishwasher 100 may be electrically connected to a sensor provided in the top door 120 to detect whether the top door 120 is opened or closed. The controller may be electrically connected to various electronical components disposed in a lower module.

When the cover frame 150 and the top door 120 among the components of the dishwasher 100 are named an "upper module" and the other components of the dishwasher 100 except for the cover frame 150, the top door 120 and the connection member 170 are named the "lower module," the lower module is first mounted on the cabinet 20 in the front-rear direction X of the system kitchen 1 in order to install the dishwasher 100 in the system kitchen 1 in a built-in manner. Specifically, the lower module is accommodated in the front-rear direction X of the system kitchen 1 in the cabinet 20 with a front open and then fixed to the cabinet 20. The upper module is then mounted to the counter 10. Specifically, the cover frame 150 is mounted on the opening 11 of the counter 10, and the top door 120 is installed on the cover frame 150. The upper module and the lower module may be connected by the connection member 170. Specifically, the cover frame 150 of the upper module and the tub 110 of the lower module may be connected by the connection member 170.

Hereinafter a frame injector 400 disposed on the cover frame 150 will be described in detail.

Figure 6:
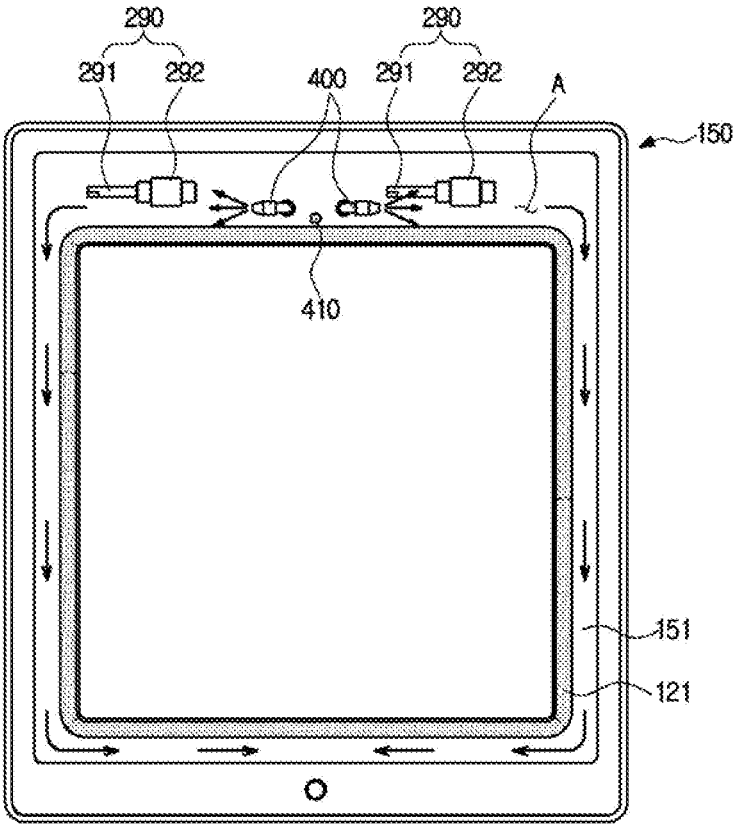
FIG. 6 is a plan view illustrating the cover frame, a top door hinge and the frame injector of the dishwasher according to an embodiment of the present disclosure.
Figure 7:
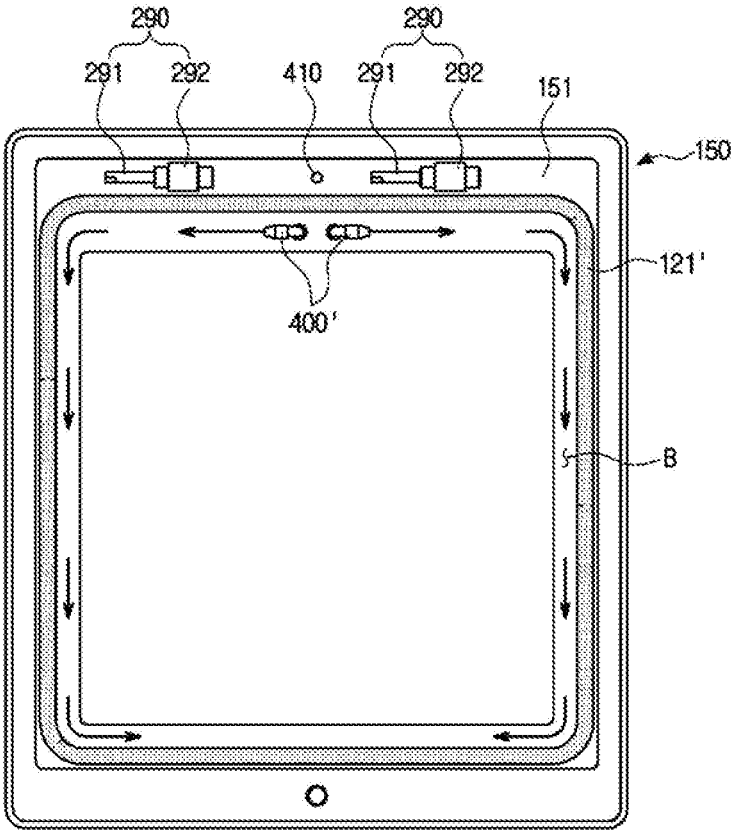
FIG. 7 is a plan view illustrating a cover frame, a top door hinge and a frame injector of a dishwasher according to another embodiment of the present disclosure.

FIG. 5 is a perspective view illustrating a cover frame and a frame injector of the dishwasher according to an embodiment of the present disclosure, FIG. 6 is a plan view illustrating the cover frame, a top door hinge and the frame injector of the dishwasher according to an embodiment of the present disclosure, and FIG. 7 is a plan view illustrating a cover frame, a top door hinge and a frame injector of a dishwasher according to another embodiment of the present disclosure.

As illustrated in FIG. 5, the dishwasher 100 according to an embodiment of the present disclosure may include the frame injector 400 disposed on the cover frame 150.

In the case of the dishwasher 100 installed in the system kitchen 1 in a built-in manner, water generated in the sink 30 or the counter 10 may be introduced into the dishwasher 100. The water introduced from the sink 30 or the counter 10 may be introduced into the cover frame 150 disposed at the same height as the counter 10 in the up-down direction and may be collected in the seating portion 151 along the first wall 152.

As described above, the seating portion 151 is provided to be in close contact with the top door sealing member 121 in a state where the top door 120 is closed. Accordingly, in the seating portion 151, water introduced from the outside may be collected in a sealing member outer region A of the seating portion 151 positioned outside the top door sealing member 121 with respect to the center of the tub 110.

In other words, in the seating portion 151, water generated in the outside may be introduced into and collected in the sealing member outer region A of the seating portion 151 which is a space formed by the top door sealing member 121, the first wall 152, and four of the side surfaces 124 of the top door (see FIG. 2).

The water collected in the sealing member outer region A may be contaminated water including foreign substances as water introduced from the sink 30 or the counter 10. When the contaminated water is collected in the cover frame 150, foreign substances may also be introduced into the cover frame 150 to cause the cover frame 150 to be contaminated.

On the contrary, when the top door sealing member 121 is not in close contact with the seating portion 151 so that the top door sealing member 121 does not seal the seating portion 151, the washing water generated from the tub 110 may pass through the top door sealing member 121 and be introduced into the sealing member outer region A.

The washing water introduced from the tub 110 may include foreign substances after washing the tableware. Accordingly, when the washing water introduced from the tub 110 is collected in the sealing member outer region A, foreign substances may be introduced into the cover frame 150 together with the washing water to contaminate the cover frame 150.

Therefore, the dishwasher 100 according to an embodiment of the present disclosure may include the frame injector 400 disposed on the cover frame 150 to remove foreign substances, etc. introduced into the seating portion 151. The frame injector 400 may not only solve the above-described problem but also additionally solve various other problems, which will be described later.

The frame injector 400 may be disposed on the seating portion 151 to remove foreign substances introduced into the seating portion 151 through injection of the washing water. That is, the frame injector 400 may inject the washing water onto the seating portion 151 to flow foreign substances, etc. present on the seating portion 151 together with the washing water.

As illustrated in FIG. 5, a pair of the frame injectors 400 may be disposed on the seating portion 151. The pair of frame injectors 400 may inject the washing water in opposite directions. Accordingly, the washing water may be injected into the entire space of the seating portion 151, so that foreign substances on the seating portion 151 may be easily removed. Because the pair of frame injectors 400 are driven the same, only one of the frame injector 400 will be described below.

The frame injector 400 may inject the washing water, which has been pumped from the washing pump 181, to the cover frame 150 through an additional supply pipe (not shown). The additional supply pipe (not shown) may be branched from the first supply pipe 260 or the second supply pipe 270 to extend to the frame injector 400.

The frame injector 400 may be disposed in the sealing member outer region A of the seating portion 151. That is, the frame injector 400 may be disposed outside the top door sealing member 121 with respect to the center of the tub 110.

As illustrated in FIG. 6, the frame injector 400 may be disposed adjacent to the hinge mounting portion 292 and may be provided to inject the washing water toward the hinge mounting portion 292. The hinge mounting portion 292 is mounted to the cover frame 150 in the sealing member outer region A and formed to protrude upward from the seating portion 151 so that foreign substances and the like may be intensively collected in the hinge mounting portion 292. Accordingly, the frame injector 400 may be provided to inject the washing water toward the hinge mounting portion 292 to easily remove foreign substances collected in the hinge mounting portion 292 side.

As illustrated in FIG. 7, a frame injector 400' may be disposed at an inner side of a top door sealing member 121' with respect to the center of the tub 110 as another embodiment of the technical feature in which the frame injector 400 is disposed.

That is, the frame injector 400' may be disposed in a sealing member inner region B of the seating portion 151 positioned inside the top door sealing member 121' with respect to the center of the tub 110.

The sealing member inner region B is a region between an inner end of the seating portion 151 and a point in contact with the top door sealing member 121', and water is not introduced into the sealing member inner region B from the outside by the top door sealing member 121', but the washing water may be introduced into and collected in the sealing member inner region B from the tub 110.

As described above, the washing water introduced from the tub 110 may include foreign substances after washing the tableware. Accordingly, when the washing water introduced from the tub 110 is collected in the sealing member inner region B, the foreign substances may be introduced into the cover frame 150 together with the washing water to contaminate the cover frame 150.

As such, the frame injector 400' to inject the washing water may be disposed at the sealing member inner region B to remove foreign substances present on the sealing member inner region B. The washing water injected from the frame injector 400' may flow along the sealing member inner region B together with the foreign substances present on the sealing member inner region B, thereby removing the foreign substances from the cover frame 150. The washing water injected into the sealing member inner region B may be introduced into the tub 110 along the second wall 153 together with the foreign substances.

Hereinafter a technical feature in which water collected in the sealing member outer region A is drained will be described in detail.

Figure 8:
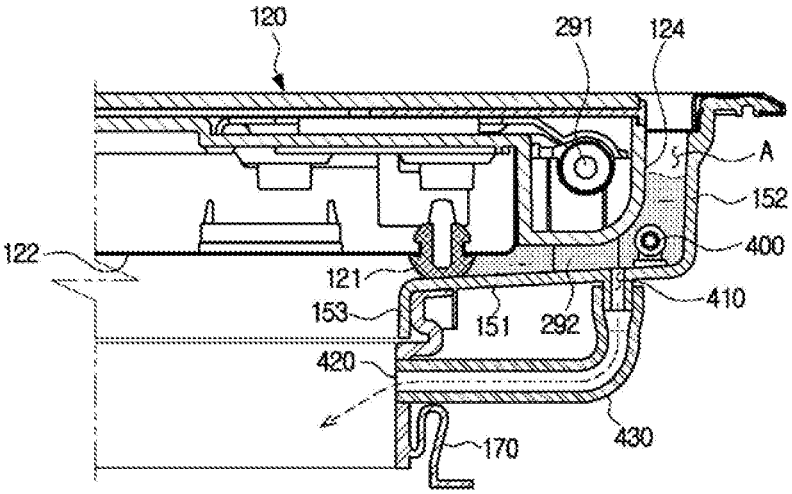
FIG. 8 is an enlarged side cross-sectional view of a portion of the dishwasher according to an embodiment of the present disclosure.
Figure 9:
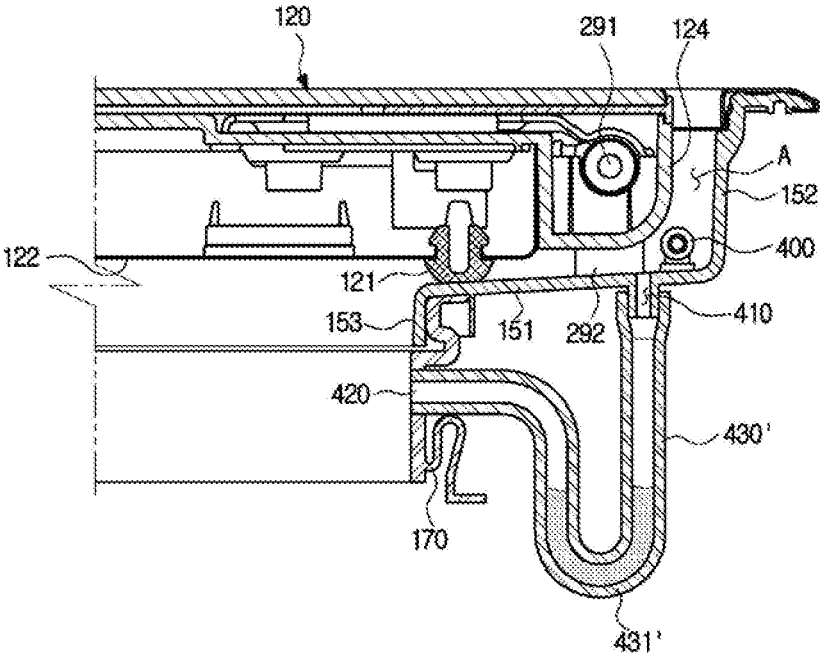
FIG. 9 is an enlarged side cross-sectional view of a portion of a dishwasher according to another embodiment of the present disclosure.

FIG. 8 is an enlarged side cross-sectional view of a portion of the dishwasher according to an embodiment of the present disclosure, and FIG. 9 is an enlarged side cross-sectional view of a portion of a dishwasher according to another embodiment of the present disclosure.

As described above, the cover frame 150 according to an embodiment of the present disclosure may include a drain hole 410 provided to drain the collected water when water generated in the counter 10 or the sink 30 is introduced into the dishwasher 100 and collected in the sealing member outer region A, or when the washing water is injected to the sealing member outer region A by the frame injector 400.

As illustrated in FIG. 9, the water collected in the sealing member outer region A may be drained outward from the cover frame 150 through the drain hole 410. The drain hole 410 may be connected to an inlet hole 420 for introducing the water collected into the tub 110 through a connection hose 430.

The drain hole 410 may be disposed on the seating portion 151. In detail, the drain hole 410 may be disposed in the sealing member outer region A of the seating portion 151 to drain the water collected in the sealing member outer region A to the outside of the cover frame 150.

The drain hole 410 may be disposed adjacent to the frame injector 400. However, the present disclosure is not limited thereto, and the drain hole 410 may be disposed on any one side of the sealing member outer region A.

The inlet hole 420 may be provided to allow the water drained from the drain hole 410 to be introduced into the tub 110. The inlet hole 420 is disposed on the connection member 170 disposed below the second wall 153 to allow the water drained through the drain hole 410 to be introduced into the tub 110 disposed below the second wall 153. Although not shown in the drawing, the inlet hole 420 may be disposed on the second wall 153.

The connection hose 430 is provided between the drain hole 410 and the inlet hole 420 to transfer the water drained from the drain hole 410 to the inlet hole 420. The inlet hole 420 may be provided at one end of the connection hose 430 to direct to the inside of the tub 110.

When the inlet hole 420 is disposed on the second wall 153, the connection hose 430 may pass through the connection member 170 to connect the drain hole 410 to the inlet hole 420.

The inlet hole 420 is not limited to an embodiment of the present disclosure but may be disposed on the cover frame 150 described above or other configuration.

As another embodiment of the connection hose 430, as illustrated in FIG. 9, a connection hose 430' may include a U-shaped region 431' disposed lower than the inlet hole 420 and having a 'U' shape.

According to an embodiment of the present disclosure described above, a part of the washing water present in the tub 110 may be introduced into the inlet hole 420 and then reversely introduced into the sealing member outer region A through the connection hose 430 and the drain hole 410. In addition, wet steam generated through a washing process in the tub 110 may be introduced into the inlet hole 420 and then introduced into the sealing member outer region A through the connection hose 430 and the drain hole 410 to contaminate the cover frame 150.

The connection hose 430' according to another embodiment of the present disclosure may include the U-shaped region 431' to prevent water or wet steam from being introduced into the sealing member outer region A from the tub 110. That is, the U-shaped region 431' may collect water or wet steam so that the water or wet steam introduced from the tub 110 may not reach the drain hole 410. Accordingly, the washing water introduced from the tub 110 through the inlet hole 420 does not reach the sealing member outer region A, thereby preventing an additional contamination of the cover frame 150.

Figure 10:
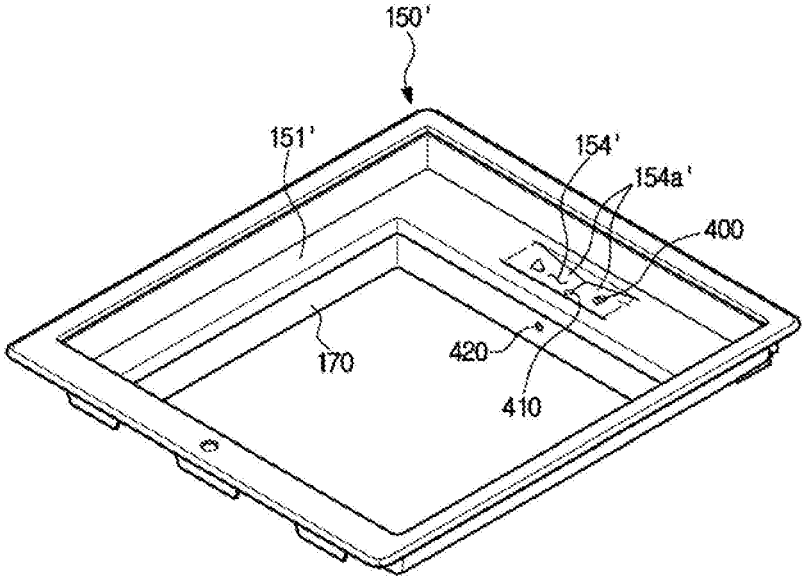
FIG. 10 is a perspective view illustrating a cover frame and a frame injector of a dishwasher according to another embodiment of the present disclosure.

Hereinafter a cover frame 150' of the dishwasher 100 according to another embodiment of the present disclosure will be described. The configuration other than the cover frame 150' described below is similar to that of the cover frame 150 according to an embodiment of the present disclosure, and thus redundant description thereof will be omitted. FIG. 10 is a perspective view illustrating a cover frame and a frame injector of a dishwasher according to another embodiment of the present disclosure.

As illustrated in FIG. 10, the cover frame 150' may include a water collecting region 154' formed to be lower than a height of a seating portion 151' in the up-down direction.

The water collecting region 154' is disposed on the seating portion 151', and in detail, is disposed on the sealing member outer region A, and has a gradient formed to be lower than the height of the seating portion 151' as described above to intensively collect the water collected in the sealing member outer region A in the water collecting region 154'.

The water collecting region 154' may include an inclined surface **154*a* extending downward from the seating portion 151'. The water collected in the seating portion 151' may be intensively collected in the water collecting region 154' along the inclined surface 154*a'***.

The drain hole 410 may be disposed at the lowest point in the water collecting region 154'. The water collected in the cover frame 150' may be easily drained by the drain hole 410 being disposed at a region in which water is intensively collected.

According to FIG. 10, the frame injector 400 may be disposed on the inclined surface **154*a'*, but the present disclosure is limited thereto, and the frame injector 400 may be disposed outside the water collecting region 154'. In addition, the hinge mounting portion 292 may be disposed on the inclined surface 154*a'*, but the present disclosure is not limited thereto, and the hinge mounting portion 292 may be disposed outside the water collecting region 154'**.

Also, according to FIG. 10, the water collecting region 154' is disposed at a rear side of the seating portion 151' to which the hinge mounting portion 292 is coupled, but the present disclosure is not limited thereto, and the water collecting region 154' may be disposed on any one side of the seating portion 151'. However, in this case, the drain hole 410 may be disposed to correspond to any one side where the water collecting region 154' is disposed.

Although not shown in the drawing, the water collecting region 154' does not include the inclined surface **154*a'*** and may be provided in a step shape.

Figure 11:
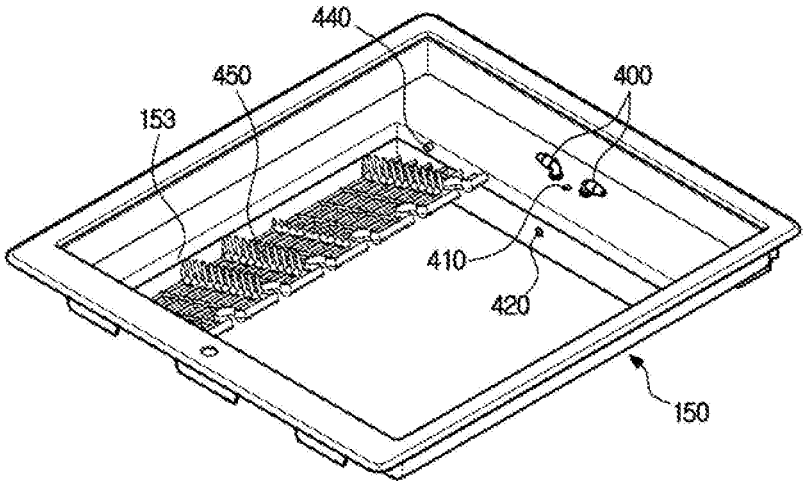
FIG. 11 is a perspective view illustrating a cover frame, a simple tray, a frame injector, and an auxiliary frame injector of a dishwasher according to another embodiment of the present disclosure.

Hereinafter a simple tray 450 and an auxiliary frame injector 440 of the dishwasher 100 according to another embodiment of the present disclosure will be described. Other configurations other than the simple tray 450 and the auxiliary frame injector 440 described below are similar to the configurations according to an embodiment of the present disclosure described above, and thus redundant description thereof will be omitted. FIG. 11 is a perspective view illustrating a cover frame, a simple tray, a frame injector, and an auxiliary frame injector of a dishwasher according to another embodiment of the present disclosure.

As illustrated in FIG. 11, the dishwasher 100 according to another embodiment of the present disclosure may include the simple tray 450 disposed in the second washing space 340 defined by an inner region of the cover frame 150.

The simple tray 450 may be disposed adjacent to the top door 120 so that the top door 120 may be opened to load tableware. In detail, the simple tray 450 may be supported on one side of the second wall 153 of the cover frame 150.

The simple tray 450 may be loaded with tableware having a small volume. The user may load and wash tableware having a small volume such as a cup or a cutlery in the simple tray 450.

In the case of the tableware having a small volume, when the tableware is loaded on the upper basket 161 or the lower basket 162, the tableware may escape between the wires 163 of the baskets 161 and 162, but when the tableware having a small volume is loaded on the simple tray 450, the tableware may not escape between the wires 163, thereby easily washing the tableware having a small volume.

As described above, the simple tray 450 may be supported on the second wall 153, but is disposed relatively far from the first injector 210 or the second injector 220, so that a large amount of washing water may not reach the simple tray 450. Accordingly, the tableware loaded on the simple tray 450 may not be completely washed, but the dishwasher according to another embodiment of the present disclosure may solve this problem by including the auxiliary frame injector 440.

The auxiliary frame injector 440 may be disposed on the second wall 153 to inject the washing water toward the simple tray 450. The auxiliary frame injector 440 may additionally inject the washing water onto the simple tray 450 to assist in washing of the tableware loaded on the simple tray 450.

As illustrated in FIG. 11, the auxiliary frame injector 440 may be disposed on the other side besides one side of the second wall 153 on which the simple tray 450 is supported, but the present disclosure is not limited thereto, and the auxiliary frame injector 440 may be disposed together with the simple tray 450 on one side of the second wall 153 on which the simple tray 450 is supported.

The auxiliary frame injector 440 may receive the washing water by a supply pipe branched from an additional supply pipe (not shown) for supplying the washing water to the frame injector 400. Alternatively, the washing water may be supplied through another additional supply pipe (not shown) directly connected to the washing pump 181.

The washing water injected from the auxiliary frame injector 440 may be introduced into the tub 110 and collected in the sump 180.

Figure 12:
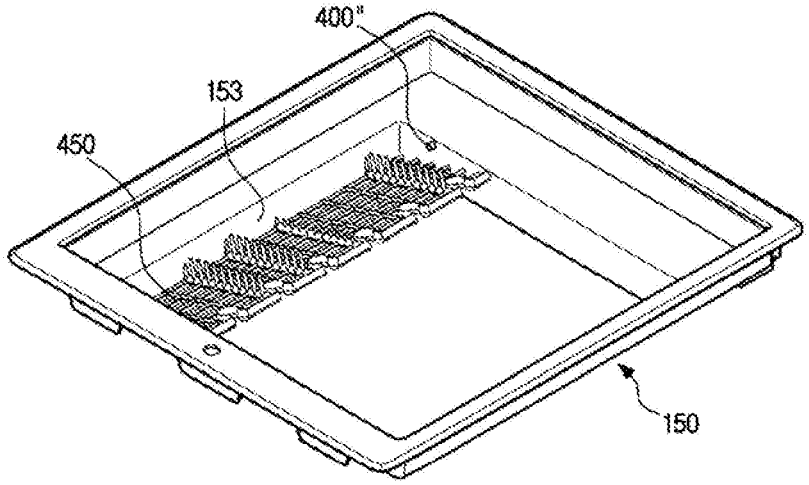
FIG. 12 is a perspective view illustrating a cover frame, a simple tray, and a frame injector of a dishwasher according to another embodiment of the present disclosure.

Hereinafter the simple tray 450 and a frame injector 400" of the dishwasher 100 according to another embodiment of the present disclosure will be described. Other configurations other than the simple tray 450 and the frame injector 400" described below are similar to the configurations according to an embodiment of the present disclosure described above, and thus redundant description thereof will be omitted. FIG. 12 is a perspective view illustrating a cover frame, a simple tray, and a frame injector of a dishwasher according to another embodiment of the present disclosure.

As illustrated in FIG. 12, the dishwasher 100 according to another embodiment of the present disclosure may include the simple tray 450 disposed in the second washing space 340 defined by an inner region of the cover frame 150. The simple tray 450 may be supported on one side of the second wall 153 of the cover frame 150.

The dishwasher 100 according to another embodiment of the present disclosure may include the frame injector 400" disposed on the cover frame 150 to inject the washing water toward the simple tray 450.

The frame injector 400" may be disposed on the second wall 153 to inject the washing water toward the simple tray 450. The frame injector 400" may additionally inject the washing water onto the simple tray 450 to assist in washing of the tableware loaded on the simple tray 450.

Hereinafter a dishwasher **100*a*** according to another embodiment of the present disclosure will be described. The dishwasher may itself be provided in the kitchen, rather than being built-in to the system kitchen. This type of dishwasher is defined as a free standing type dishwasher. Hereinafter the free standing type dishwasher will be described.

Figure 13:
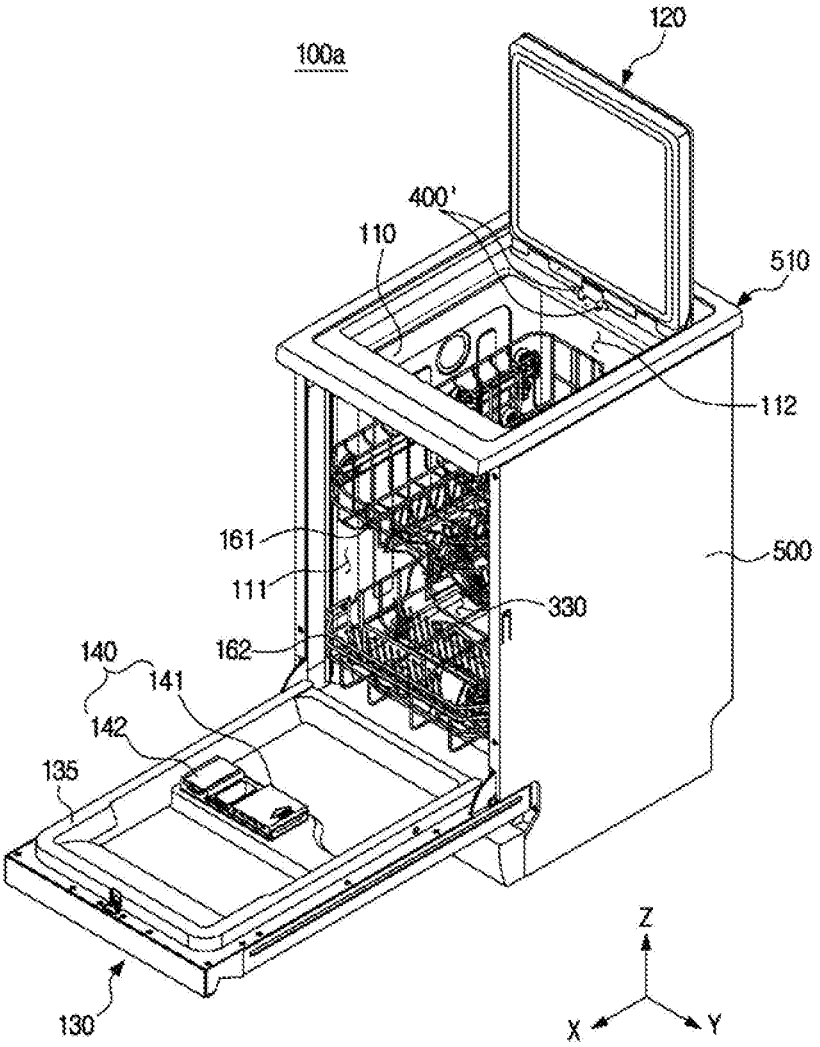
FIG. 13 is a perspective view of a dishwasher according to another embodiment of the present disclosure.
Figure 14:
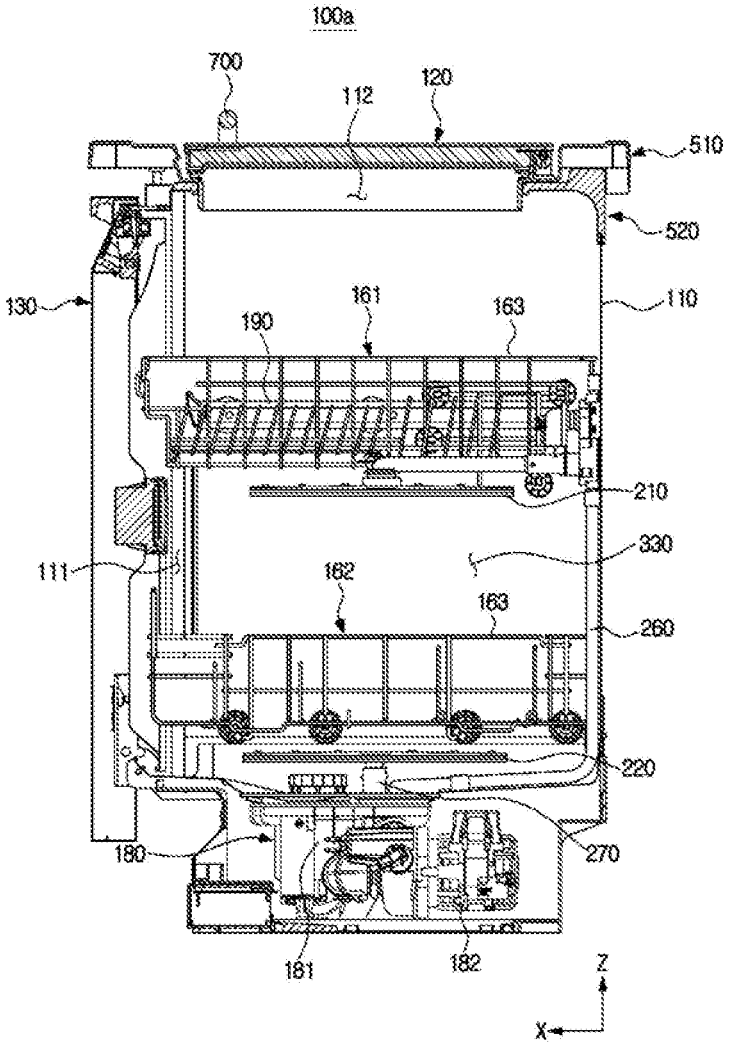
FIG. 14 is a cross-sectional view taken along line I-I' in the dishwasher of FIG. 13.
Figure 15:
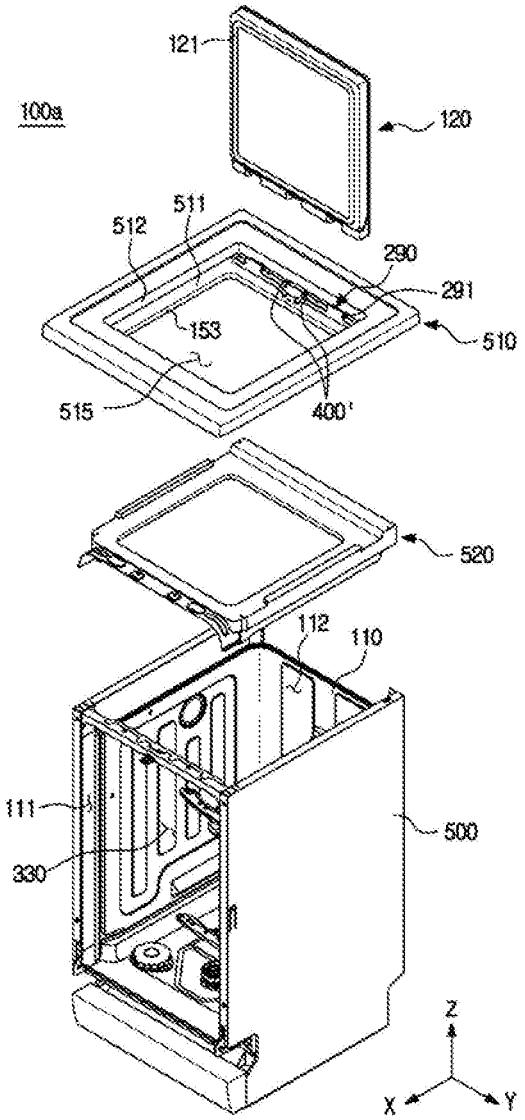
FIG. 15 is an exploded perspective view of a dishwasher according to another embodiment of the present disclosure.
Figure 16:
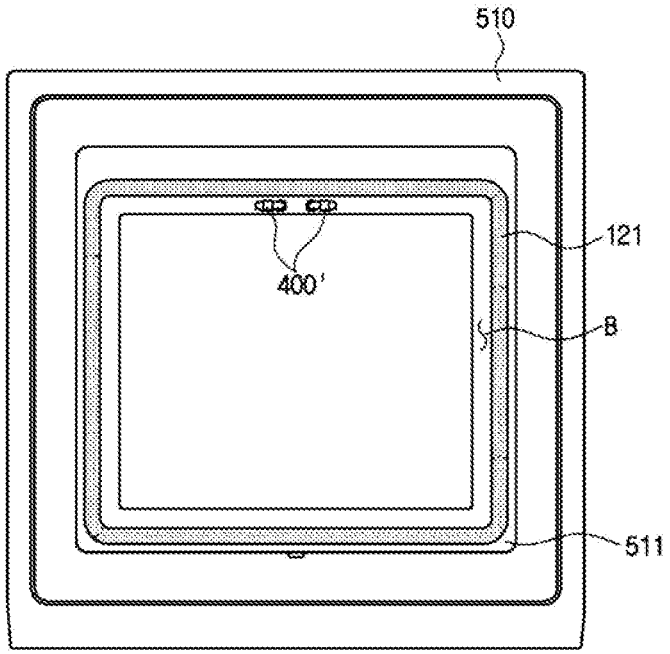
FIG. 16 is a plan view illustrating a cover frame and a frame injector of a dishwasher according to another embodiment of the present disclosure.

FIG. 13 is a perspective view of a dishwasher according to another embodiment of the present disclosure, FIG. 14 is a cross-sectional view taken along line I-I' in the dishwasher of FIG. 13, FIG. 15 is an exploded perspective view of a dishwasher according to another embodiment of the present disclosure, and FIG. 16 is a plan view illustrating a cover frame and a frame injector of a dishwasher according to another embodiment of the present disclosure.

Hereinafter a description overlapping with the description of the built-in type dishwasher will be omitted.

As illustrated in FIGS. 13 to 16, the dishwasher **100*a* may include a housing 500** forming an appearance.

The dishwasher **100*a* may further include the tub 110 having the washing space 330 formed therein. The tub 110 may be disposed inside the housing 500. The tub 110 may include the front opening 111 capable of being opened and closed by the front door 130. Preferably, the front opening 111 may be larger than an opening 515 formed on a cover frame 510. The tub 110 may further include the top opening 112 provided to correspond to the opening 515 formed on the cover frame 510**.

The dishwasher **100*a* may further include the plurality of doors 120 and 130 for the convenience of the user. Specifically, the dishwasher 100*a* may include the top door 120 provided to enable top loading of tableware, and the front door 130 provided to enable front loading of the tableware. The top door 120 and the front door 130 may be rotatably installed. However, the installation manner of the top door 120 and the front door 130 is not limited to the above example, and may be variously changed. Hereinafter the case where the top door 120 and the front door 130 are rotatably installed will be described. The top door 120 may be rotatably installed on the cover frame 510. The front door 130 may be rotatably installed on the tub 110**.

The front door 130 may be provided with the detergent supply device 140 including at least one of the detergent box 141 to supply a detergent to the inside of the tub 110 and the rinse box 142 to supply a rinse to the inside of the tub 110.

A handle 700 may be installed at the top door 120 to facilitate opening and closing of the top door 120.

The dishwasher **100*a* may further include the cover frame 510. The cover frame 510 may be mounted on an upper portion of the tub 110. The top door 120 may be installed to the cover frame 510**.

The cover frame 510 may include a seating portion 511 provided to seat the top door 120. Specifically, the top door hinge 290 including the hinge shaft 291 may be mounted on the seating portion 511 of the cover frame 400. The top door 120 is coupled to the top door hinge 290 to be rotatable about the hinge shaft 291. The hinge shaft 291 of the top door hinge 290 may extend in the left-right direction Y of the dishwasher **100*a***.

The cover frame 510 may further include a first wall 512 extending from the seating portion 511 in the up-down direction Z of the dishwasher **100*a*. Specifically, the first wall 512 may extend in the up-down direction Z of the dishwasher 100*a* to direct upward of the dishwasher 100*a* from an outer end portion of the seating portion 511. The seating portion 511 may face the bottom surface of the top door 120, and the first wall 512 may face the side surface of the top door 120. In another aspect, the seating portion 511 and the first wall 512 may define a top door accommodation space in which the top door 120** is accommodated.

The cover frame 510 may further include a second wall 513 extending in the up-down direction Z of the dishwasher **100*a* from the seating portion 151. Specifically, the second wall 513 may extend in the height direction Z of the dishwasher 100*a* to direct downward of the dishwasher 100*a* from an inner end portion of the seating portion 511**.

The first wall 512 may extend further in the up-down direction Z of the dishwasher **100*a* than the second wall 513. That is, a height of the first wall 512 may be higher than a height of the second wall 513 in the up-down direction Z of the dishwasher 100*a***.

A space defined by the first wall 512 may have a width wider than a space defined by the second wall 513 in the left-right direction Y of the dishwasher **100*a***.

The dishwasher 100*a* may further include a top door sealing member 121. The top door sealing member 121 may be coupled to the top door 120. The top door sealing member 121 serves to complement sealing between the top door 120 and the cover frame 510 to prevent the washing water in the tub 110 from leaking to the outside of the top door 120. The top door sealing member 121 may be formed of an elastic material. As an example, the top door sealing member 121 may be formed of rubber or the like.

The dishwasher 100*a* may further include a connection frame 520 disposed between the tub 110 and the cover frame 510. The connection frame 520 may be disposed between the cover frame 510 and the tub 110 in the up-down direction Z of the dishwasher 100*a* to connect the cover frame 510 to the tub 110.

The dishwasher 100*a* may further include the one or more baskets 161 and 162 disposed inside the tub 110 to be withdrawn through the front opening 111. The one or more baskets 161 and 162 may also be named "front loading baskets." As an example, the dishwasher 100*a* may include the upper basket 161 disposed at the upper portion of the tub 110 in the up-down direction Z of the dishwasher 100*a*, and the lower basket 162 disposed below the upper basket 161 in the up-down direction Z of the dishwasher 100*a*. The upper basket 161 may be disposed adjacent to an additional basket 170, which will be described later. A description of the one or more baskets 161 and 162 will be omitted as it overlaps with those described with reference to FIGS. 3 and 4.

The dishwasher 100*a* may further include the front door sealing member 135. The front door sealing member 135 may be coupled to the front door 130. The front door sealing member 135 serves to complement sealing between the tub 110 and the front door 130 to prevent the washing water in the tub 110 from leaking to the outside of the front door 130. The front door sealing member 135 may be formed of an elastic material. As an example, the front door sealing member 135 may be formed of rubber or the like.

The front door 130 of the dishwasher 100*a* may form a front appearance of the dishwasher 100*a*.

The top door 120 of the dishwasher 100*a* may form a top appearance of the dishwasher 100*a*. Specifically, the top door 120 of the dishwasher 100*a* may form the top appearance of the dishwasher 100*a* together with the cover frame 510.

The dishwasher 100*a* according to another embodiment of the present disclosure may include the frame injector 400' disposed on the cover frame 510. The frame injector 400' may be disposed at an inner side of the top door sealing member 121 with respect to the center of the tub 110.

That is, the frame injector 400' may be disposed in the sealing member inner region B of the seating portion 511 positioned inside the top door sealing member 121 with respect to the center of the tub 110.

The sealing member inner region B is a region between the inner end of the seating portion 511 and a point in contact with the top door sealing member 121, and water is not introduced into the sealing member inner region B from the outside by the top door sealing member 121, but the washing water may be introduced into and collected in the sealing member inner region B from the tub 110.

As described above, the washing water introduced from the tub 110 may include foreign substances after washing the tableware. Accordingly, when the washing water introduced from the tub 110 is collected in the sealing member inner region B, the foreign substances may be introduced into the cover frame 510 together with the washing water to contaminate the cover frame 510.

As such, the frame injector 400' to inject the washing water may be disposed at the sealing member inner region B to remove foreign substances present on the sealing member inner region B. The washing water injected from the frame injector 400' may flow along the sealing member inner region B together with the foreign substances present on the sealing member inner region B, thereby removing the foreign substances from the cover frame 510. The washing water injected into the sealing member inner region B may be introduced into the tub 110 along the second wall 513 together with the foreign substances.

Figure 17:
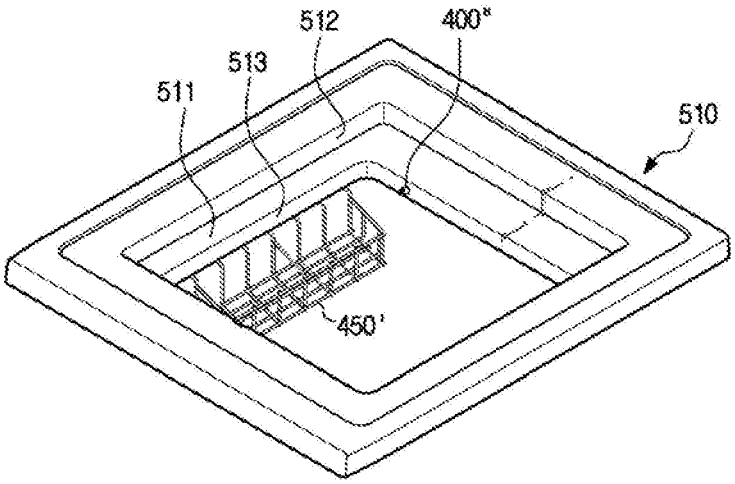
FIG. 17 is a perspective view illustrating a cover frame, a frame injector, and a simple tray of a dishwasher according to another embodiment of the present disclosure.

Hereinafter the simple tray 450 and the frame injector 400' of the dishwasher 100*a* according to another embodiment of the present disclosure will be described. Other configurations other than the simple tray 450 and the frame injector 400' described below are similar to the configurations according to an embodiment of the present disclosure described above, and thus redundant description thereof will be omitted. FIG. 17 is a perspective view illustrating a cover frame, a frame injector, and a simple tray of a dishwasher according to another embodiment of the present disclosure.

As illustrated in FIG. 17, the dishwasher 100*a* according to another embodiment of the present disclosure may include the simple tray 450 disposed on an inner region of the cover frame 510. The simple tray 450 may be supported on one side of the second wall 513 of the cover frame 510.

The dishwasher 100*a* according to another embodiment of the present disclosure may include the frame injector 400" disposed on the cover frame 510 to inject the washing water toward the simple tray 450.

The frame injector 400" may be disposed on the second wall 513 to inject the washing water toward the simple tray 450. The frame injector 400" may additionally inject the washing water onto the simple tray 450 to assist in washing of the tableware loaded on the simple tray 450.

The present disclosure has been particularly described with reference to exemplary embodiments. However, it should be understood by those of skilled in the art that various changes in form and details may be made without departing from the spirit and scope of the present disclosure.

The invention claimed is:

1. A dishwasher comprising:

a tub having a front opening and a top opening;

a front door configured to open and close the front opening;

a cover frame disposed on the top opening and including an opening opened in the up-down direction;

a top door configured to rotate or slide to open and close the opening of the cover frame and so that, when the opening of the cover frame is opened by the top door, items to be washed by the dishwasher are passable through the opening of the cover frame and the top opening of the tub to be placed inside the dishwasher and items inside the dishwasher that have been washed by the dishwasher are passable through the top opening of the tub and the opening of the cover frame to be taken out of the dishwasher; and a frame injector disposed on the cover frame to inject washing water from one side of the cover frame.

2. The dishwasher according to claim 1, further comprising a simple tray disposed on an inner wall of the cover frame, wherein the frame injector is configured to inject the washing water toward the simple tray.

3. The dishwasher according to claim 1, further comprising a simple tray disposed on an inner wall of the cover frame and an auxiliary frame injector disposed on the cover frame and configured to inject the washing water toward the simple tray.

4. The dishwasher according to claim 1, wherein the cover frame further includes a seating portion configured to face a lower surface of the top door when the top door is closed, and the frame injector is disposed on the seating portion to remove foreign substances on the seating portion.

5. The dishwasher according to claim 1, wherein the cover frame further includes a drain hole to drain the washing water collected in the cover frame.

6. A dishwasher comprising:

a tub having a front opening and a top opening;

a front door configured to open and close the front opening;

a cover frame disposed on the top opening and including an opening opened in the up-down direction;

a top door configured to open and close the opening of the cover frame; and a frame injector disposed on the cover frame to inject washing water from one side of the cover frame, wherein the cover frame further includes a seating portion configured to face a lower surface of the top door when the top door is closed, and the frame injector is disposed on the seating portion to remove foreign substances on the seating portion.

7. The dishwasher according to claim 6, further comprising a door hinge disposed at the seating portion to allow the top door to be rotatably coupled to the cover frame, wherein the frame injector is disposed at an outer side of the hinge member on the seating portion with respect to a center of the tub.

8. The dishwasher according to claim 7, wherein the frame injector is configured to inject the washing water toward the door hinge.

9. The dishwasher according to claim 6, wherein the top door includes a sealing member provided on the lower surface of the top door to be in contact with the seating portion when the top door is closed, and the frame injector is disposed at an outer side of the sealing member with respect to a center of the tub.

10. The dishwasher according to claim 6, wherein the top door includes a sealing member provided on the lower surface of the top door to be in contact with the seating portion when the top door is closed, and the frame injector is disposed at an inner side of the sealing member with respect to a center of the tub.

11. The dishwasher according to claim 6, wherein the seating portion includes a water collecting region provided at a relatively low height with respect to the up-down direction such that the washing water injected from the frame injector is collected in one side of the seating portion.

12. A dishwasher comprising:

a tub having a front opening and a top opening;

a front door configured to open and close the front opening;

a cover frame disposed on the top opening and including an opening opened in the up-down direction;

a top door configured to open and close the opening of the cover frame; and a frame injector disposed on the cover frame to inject washing water from one side of the cover frame, wherein the cover frame further includes a drain hole to drain the washing water collected in the cover frame.

13. The dishwasher according to claim 12, wherein the cover frame further includes a seating portion configured to face a lower surface of the top door when the top door is closed, a lower inner wall extending from an inner end of the seating portion to the tub side, an inlet hole disposed on the lower inner wall such that the washing water drained from the drain hole is introduced into the tub, and a connection hose to connect the drain hole to the inlet hole.

14. The dishwasher according to claim 13, further comprising a connection member to connect an upper end of the tub to the cover frame, wherein the connection hose is configured to penetrate the connection member to connect the drain hole to the inlet hole.

15. The dishwasher according to claim 13, wherein the connection hose includes a U-shaped region having a 'U' shape formed lower than the inlet hole in the up-down direction.

16. The dishwasher according to claim 13, wherein the drain hole is disposed on the seating portion.

17. The dishwasher according to claim 13, wherein the seating portion includes a water collecting region provided at a relatively low height with respect to the up-down direction such that the washing water injected from the frame injector is collected in the drain hole side.

* * * * *